United States Patent [19]

Cillis

[11] 4,222,541

[45] Sep. 16, 1980

[54] LADDER TRAY SUPPORT ATTACHMENT

[76] Inventor: Daniel J. Cillis, 17225 Robey Dr., Castro Valley, Calif. 94546

[21] Appl. No.: 969,354

[22] Filed: Dec. 14, 1978

[51] Int. Cl.[2] ..... E06C 7/14

[52] U.S. Cl. ..... 248/210; 248/311.2

[58] Field of Search ..... 248/210, 211, 310, 311.1 R, 248/313

[56] References Cited

U.S. PATENT DOCUMENTS

| | | | |
|---|---|---|---|
| 1,221,658 | 4/1917 | Berry | 248/210 |
| 1,972,064 | 8/1934 | Moushon | 248/210 |
| 2,056,527 | 10/1936 | Kummer | 248/210 |
| 2,759,620 | 8/1956 | Pharris | 248/210 |
| 2,883,134 | 4/1959 | O'Halloran | 248/210 |
| 2,912,205 | 11/1959 | Toune | 248/210 |
| 3,111,297 | 11/1963 | Conner | 248/210 |
| 3,239,181 | 3/1966 | Ellerbrock | 248/210 |
| 3,987,993 | 10/1976 | Hopkins | 248/210 |

*Primary Examiner*—Roy D. Frazier
*Assistant Examiner*—Peter A. Aschenbrenner
*Attorney, Agent, or Firm*—Warren, Chickering & Grunewald

[57] ABSTRACT

A demountable ladder tray support is disclosed which allows a tray for holding tools, paint brushes, paint and the like to be carried adjacent to the side rail of a ladder at any height desired by the user. The ladder tray support is mounted by means of a pair of clamping plates which are adjustable to accommodate mounting on ladder side rails of all dimensions. Pivotal mounting of a tray support bracket ensures that an attached tray may be leveled regardless of the attitude of the ladder side rail.

1 Claim, 3 Drawing Figures

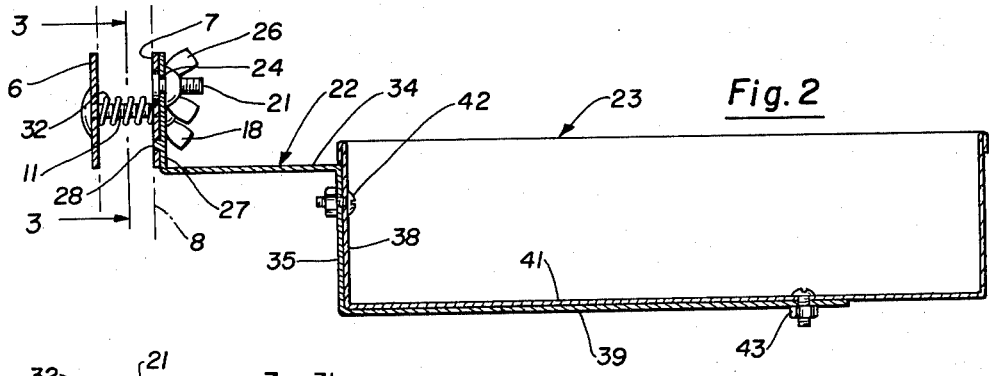
Fig. 2
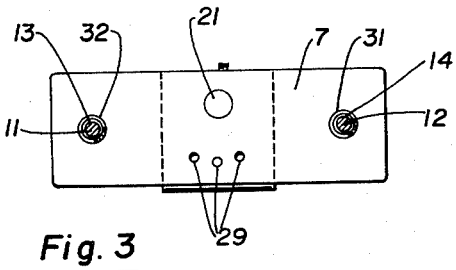
Fig. 3
Fig. 1
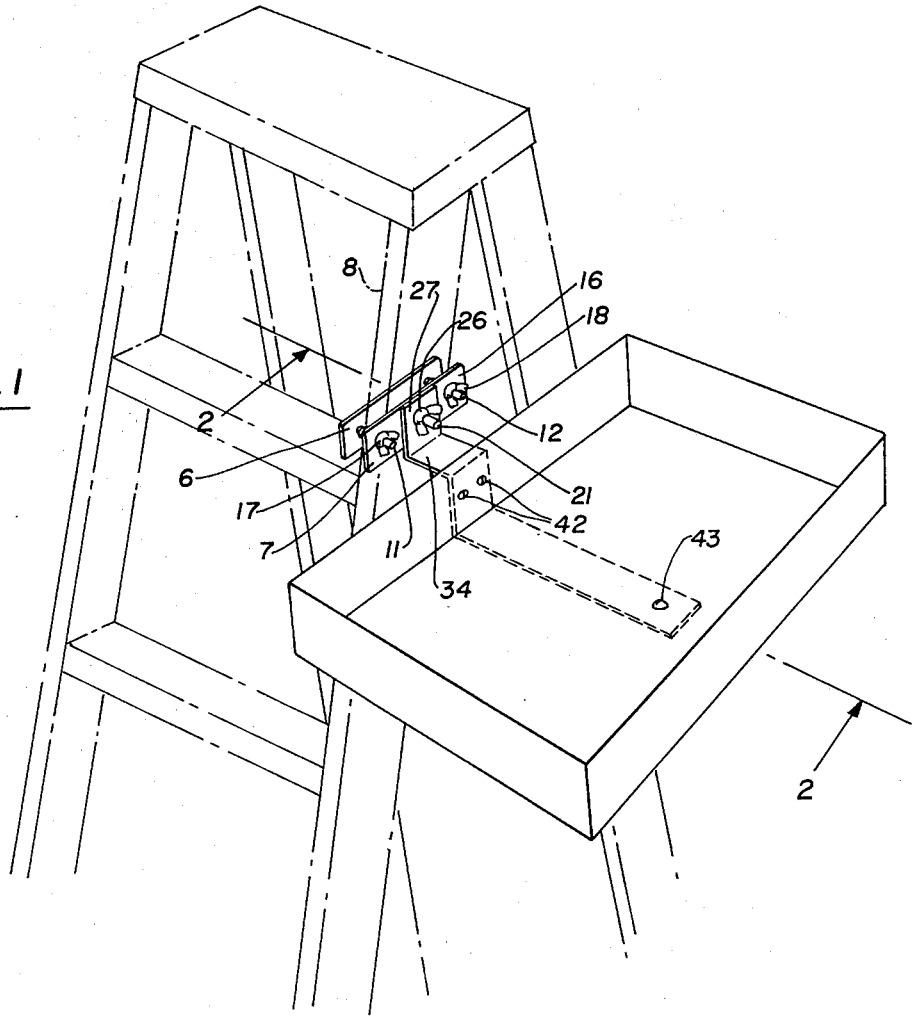

LADDER TRAY SUPPORT ATTACHMENT

BACKGROUND OF THE INVENTION

1. Field of the Invention

This invention relates to ladder associated, detachable trays or shelves for supporting tools, paint cans, paint brushes and the like.

2. Description of the Prior Art

A common problem encountered in completing construction, building repairs or painting on a ladder is the absence of convenient support at the higher ladder elevations of tools, paint, paint brushes and the like within convenient reach of the workmen. A number of prior art inventions have addressed this problem by providing detachable trays for ladders.

In order to provide maximum utility and versatility the supporting structure for a ladder tray should be easily demountable, equally suited for mounting on the left or right hand side of a ladder, and possess means for adjusting the angle of the attached tray to compensate for changes in ladder attitude. Further economic and utilitarian advantages are realized by providing a demountable tray supporting structure having simply constructed mounting and adjusting means capable of inexpensive fabrication and easy operation. The means by which a tray support structure is attached to a ladder should be adaptable to fit all types and sizes of ladders commonly in use by means of simple adjustments.

Although numerous prior art ladder trays and ladder tray supporting structures have been developed to solve certain of the aforementioned problems, none have adequately solved all of the problems. As will become apparent from the discussion which follows, however, the present invention solves each of the aforementioned problems in a simple, inexpensive and expedient manner.

The following United States Patents constitute the most pertinent art known to Applicant.

U.S. Pat. No. 639,611
U.S. Pat. No. 1,087,603
U.S. Pat. No. 1,358,277
U.S. Pat. No. 2,837,306
U.S. Pat. No. 3,131,900
U.S. Pat. No. 3,495,683
U.S. Pat. No. 3,822,847

The aforementioned prior art patents show ladder trays and supporting structures of a nature only generally similar to that herein shown, lacking specific structural features of advantage, hereinafter further described and claimed.

SUMMARY OF THE INVENTION

It is an object of the present invention to provide a ladder tray supporting structure which can be readily attached to and removed from all types of ladders commonly in use.

It is another object to provide a ladder tray support of the aforementioned character which can be easily mounted on either the left or right-hand side of a ladder.

It is still another object to provide a ladder tray support which can be fabricated from sheet metal and commonly available fasteners and having no compound curves or other complex structural features which would necessitate the employment of expensive, complicated and time-consuming fabrication techniques.

A further object of the invention is to provide a ladder tray support which may be readily adjusted by the user to ensure that an attached tray can be made level regardless of changes in ladder attitude.

A still further object of the invention is to provide a ladder tray support with a structure which neither contacts nor impedes access to the ladder steps.

A still further object of the instant invention is to provide a ladder tray support of the aforementioned character which also provides a bracket for supporting and rigidifying an attached tray.

A still further object of this invention is to provide a ladder tray support which can be securely mounted to the side rails of aluminum, fiberglass, and other types of ladders without undue stress on or deformation of the ladder side rails.

In this regard, a pair of parallel plates is used to clamp the ladder tray support to a ladder side rail thus distributing the clamping force over the greatest possible surface area and avoiding deformation which may otherwise result particularly when used on aluminum or fiberglass ladders.

In summary, these and other objects are achieved by a ladder tray support comprising a pair of support plates dimensioned for clamping on opposite sides of a ladder side rail, a pair of studs carried by a first of the plates and projecting substantially perpendicularly thereto, the studs being spaced apart to straddle said side rail, the second of the plates having openings positioned for and slidably receiving the studs with the latter projecting therethrough to an exterior side of said second plate, manually engageable means mounting on the stud ends for clamping said plates together on said side rail, a third stud carried by the second plate and projecting substantially perpendicularly from said exterior side thereof, a tray support bracket having an opening for and receiving the third stud and providing a pivotal connection for relative rotational displacement of said bracket, manually engageable means on the third stud retaining said pivotal connection, and index means mounted on said second plate in bracket for locking said bracket and second plate in selected rotated positions.

The invention possesses other objects and features of advantage, some of which of the foregoing will be set forth in the following description of the preferred form of the invention which is illustrated in the drawings accompanying and forming part of this specification. It is to be understood, however, that variations in the showing made by the said drawings and description may be adopted within the scope of the invention as set forth in the claims.

BRIEF DESCRIPTION OF THE DRAWINGS

FIG. 1 is a perspective view of a ladder tray support attachment constructed in accordance with the present invention and shown operatively assembled on a ladder.

FIG. 2 is a cross-sectional view taken substantially on the plane of line 2—2 of FIG. 1.

FIG. 3 is a cross-sectional view taken substantially on the plane of line 3—3 of FIG. 2.

DETAILED DESCRIPTION OF THE INVENTION

The demountable ladder tray support of the present invention comprises, briefly, a pair of support plates 6 and 7 dimensioned for clamping on opposite sides of a ladder side rail 8; a pair of studs 11 and 12 carried by plate 6 and projecting substantially perpendicularly thereto with the studs spaced apart as seen in FIGS. 1 and 3 to straddle ladder rail 8; and plate 7 is formed with openings 13 and 14 for slidably receiving studs 11 and 12 with the ladder extending through plate 7 and projecting to the exterior side 16 thereof as seen in FIG. 1.

Manually engageable means, here in the form of wing nuts 17 and 18 are mounted on the outer ends of studs 11 and 12 for clamping plates 6 and 7 together on side rail 8. A third stud 21 is carried by plate 7 and projects substantially perpendicular from its exterior side 16 for support of a bracket 22 for supporting a tray 23 and having an opening 24 for receiving stud 21 and providing a pivotal connection for relative rotational displacement of the bracket. Manually engageable means, here wing nut 26, is threaded onto stud 21 for retaining the pivotal connection; and index means is mounted on plate 7 and bracket 22 for locking the bracket and plate in selected rotated position. As here shown, bracket 22 is formed with an end portion 27 having a side in face-to-face confronting relation to the exterior side 16 of plate 7 and the indexing means comprises a pin 28 carried by bracket portion 27 and a plurality of arcuately spaced openings 29 in plate 7 dimensioned and positioned for receiving pin 28. Adjustment of the bracket and attached tray may be quickly and easily effected by backing off wing nut 26 to permit separation of plate 7 and bracket end 27 to remove pin 28 from one of openings 29, rotation of the bracket on stud 21 to position pin 28 in registration with another of openings 29, and retightening wing nut 26.

Attachment of the mounting plates on opposite sides of a ladder side rail is facilitated by the mounting around one of the studs 11–12 of a helical spring 31 for constantly urging the plates apart when the wing nut on the other stud is backed off to open the clamp for mounting on the opposite sides of a ladder side rail. In the present showing, helical springs 31 and 32 are mounted on studs 11 and 12, although, as noted, one will suffice. At the same time, the aforementioned indexing means may be easily and readily adjusted for horizontal positioning of tray 23 depending upon the ladder attitude.

Bracket 22 is here formed of a rigid, elongated strip, such as sheet steel, having a normally upright end 27, a contiguous normally lateral portion 24 for spacing tray 23 at a convenient distance from the ladder side rail 8, a third normally upright portion 35 depending from portion 34 and in face-to-face contact with one side 38 of tray 23, and a fourth portion 39 contiguous to and extending laterally from portion 35 and which is positioned in underlying supporting relation to the bottom 41 of tray 23. Fastening of tray 23 to bracket 22 may be conveniently effected as here shown by bolts and nuts 42 and 43 secured through the side and bottom walls of the tray to bracket sides 35 and 39, respectively.

As is clearly seen in FIG. 1, the ladder tray support of the instant invention is of extremely simple design and construction, having no complicated compound curves, special fasteners, or other exotic hardware. All of the adjustments are conveniently grouped together on the outside of the ladder side rail 4. The middle wing nut 17 is loosened by the user when it is necessary to change the attitude of the tray 22. When the proper position of the tray is found the tray 22 and bracket 15 are rotated by the user to the closest detent position and the wing nut 17 is hand-tightened to lock the tray in the newly selected position.

Plates 6 and 7 serve to distribute the clamping force exerted by the tightening of wing nuts 17 and 18 over a large surface area of the side rail for thus preventing possible damage or deformation. The helical springs 31 and 32 prevent accidental loosening of wing nuts 17 and 18 by pressing plate 7 firmly against the nuts.

While the ladder tray support is shown in FIG. 3 to be mounted on the right-hand forward ladder side rail, it could just as easily be mounted on either of the four side rails shown in the FIGURE. The device may with equal facility be mounted on the side rail of an extension ladder at any convenient height thereon. Preferably, in any case, the device is mounted to rest on one of the ladder rungs. Of particular importance, from a safety standpoint, is the minimal intrusion of the ladder tray support structure into the interior portion of the ladder. The support plates 6 and 7 do not contact or impede access to the ladder steps nor do they interfere in any other significant manner with normal use of the ladder.

By providing studs 11 and 12 of ample length, the structure of the present invention can be adjusted by means of simple manually engageable wing nuts to fit the side rail of any ladder in common use. A further safety feature is afforded by the unique structure of the present invention in that an accidental loosening or failure to tighten wing nuts 11 and 12 will not normally cause the tray 22 to fall from the ladder. Since studs 6 and 7 straddle the front and back of the side rail 4 and plates 2 and 3 straddle the sides of the side rail, a failure to tighten the wing nuts 11 and 12 will merely allow the ladder tray support to slide down the side rail until it comes into contact with a ladder step, a feature not found in certain prior art devices.

What is claimed is:

1. A demountable ladder tray support comprising:

a pair of support plates dimensioned for clamping on opposite sides of a ladder side rail;

a pair of threaded studs carried by a first of said plates and projecting substantially perpendicularly thereto, said studs being spaced apart to straddle said side rail;

the second of said plates having openings positioned for and slidably receiving said studs with the latter projecting therethrough to an exterior side of said second plate;

helical springs on said pair of studs mounted between and in compression engagement with said plates;

manually engageable nuts threaded on said stud ends for clamping said plates together on said side rail;

a third stud carried by said second plate and projecting substantially perpendicularly from said exterior side thereof;

a tray support bracket comprising a rigid elongated strip having a normally upright end providing said bracket side, a contiguous normally lateral portion for spacing a bracket supported tray from said side rail, a third normally upright portion depending from said second portion, and a fourth portion contiguous to and extending laterally from said third portion, said bracket side having an opening for and receiving said third stud and providing a pivotal connection for relative rotational displacement of said bracket;

manually engageable means on said third stud retaining said pivotal connection;

index means mounted on said second plate exterior side and said bracket side for locking said bracket and second plate in selected rotated positions, comprising a pin carried by one of said sides, and a plurality of arcuately spaced openings in the other of said sides dimensioned and positioned for receiving said pin; and a tray having a side and bottom mounted on and supported by said third and fourth portions of said strip, respectively.

* * * * *